United States Patent [19]

Kemeny et al.

[11] Patent Number: 4,993,311

[45] Date of Patent: Feb. 19, 1991

[54] ELECTROMAGNETIC PROJECTILE LAUNCHER WITH AN IMPROVED FIRING ARRANGEMENT

[75] Inventors: George A. Kemeny, Wilkins Township, Allegheny County; Dennis Pavlik, Murrysville, both of Pa.

[73] Assignee: Westinghouse Electric Corp., Pittsburgh, Pa.

[21] Appl. No.: 17,303

[22] Filed: Feb. 20, 1987

[51] Int. Cl.[5] ..... F41B 6/00

[52] U.S. Cl. ..... 89/8; 124/3; 200/147 R

[58] Field of Search ..... 89/8; 124/3; 200/147 R; 310/12; 318/38, 135

[56] References Cited

U.S. PATENT DOCUMENTS

| | | | |
|---|---|---|---|
| 2,356,040 | 8/1944 | Ellis et al. | 200/147 R |
| 4,433,607 | 2/1984 | Kemeny | 124/3 |
| 4,449,441 | 5/1984 | McAllister | 124/32 |
| 4,534,263 | 8/1985 | Heyne et al. | 89/8 |
| 4,644,119 | 2/1987 | Wu | 89/8 |

OTHER PUBLICATIONS

A. E. Herman, A New Principle in Arc Interruption, "Allis-Chalmers Electrical Review", Second Quarter, 1950, pp. 21–26.

*Primary Examiner*—Stephen C. Bentley
*Attorney, Agent, or Firm*—D. Schron

[57] ABSTRACT

An electromagnetic launcher having spaced-apart rails for launching a projectile by means of a current-carrying armature between the rails includes a breech end loop connected to a current commutating firing switch. A low resistance shorted loop is positioned in proximity to the breech loop and generates a current in a direction counter to the commutated breech current. The arrangement reduces the equivalent breech inductance which in turn reduces communication arcing energy as well as the duration of arcing, thereby prolonging firing switch life.

13 Claims, 3 Drawing Sheets

ELECTROMAGNETIC PROJECTILE LAUNCHER WITH AN IMPROVED FIRING ARRANGEMENT

BACKGROUND OF THE INVENTION

1. Field of the Invention:

The invention in general relates to current switching such as in electromagnetic parallel rail launchers and particularly to one which reduces commutation switching energy loss.

2. Description of the Prior Art:

An electromagnetic launcher basically consists of a power supply and two generally parallel electrically conducting rails between which is positioned an electrically conducting armature. Current from the power supply flows down one rail, through the armature and back along the other rail whereby a force is exerted on the armature to accelerate it, and a payload, so as to attain a desired muzzle or exit velocity. Current conduction between the parallel rails may also be accomplished by an armature in the form of a plasma or arc which creates an accelerating force on the rear of a sabot which in the bore length supports and accelerates the projectile.

In one common type of electromagnetic launcher, the power supply is comprised of a direct current homopolar generator in series with an inductive energy storage device. A firing switch is electrically connected to short the breech end of the electrically conducting rails and is in series with the power supply.

Prior to firing a projectile, the rotor of the homopolar generator is driven to a desired rotational speed at which point, with the firing switch in the closed position, current flow is established through the storage inductor. When the current through the inductor reaches a predetermined firing level, the firing switch is opened to commutate current into the projectile launching rails.

The firing switch must provide, in the closed position, a low resistance path for current flow during the charging of the storage inductor and must thereafter, in a time interval of typically less than 1 millisecond, commutate the current flow into the conducting rails.

Typical electromagnetic launchers operate at peak current magnitudes on the order of several hundred thousand to several million amperes. In the current commutation operation, somewhere in the order of 1 to 2% of the inductively-stored energy is dissipated in arcing at the firing switch contacts by the as yet non-commutated fraction of the current. The commutation or injection of current into the rails is driven by the resulting switch arc voltage, however, the arcing results in serious switch contact melting and insulating material loss such as to severely limit the useful life of the firing switch.

It is an object of the present invention to provide a commutation arrangement wherein the switch arcing energy dissipation and arcing duration are decreased so as to significantly increase switch longevity.

SUMMARY OF THE INVENTION

The electromagnetic projectile launcher of the present invention includes a pair of generally parallel conducting rails having a breech end and a muzzle end and includes an armature for conducting current between the rails for propelling a projectile along the rails. A source of high current such as one having a storage inductor is provided and current from the storage inductor is injected into a breech loop to commence projectile acceleration, the breech loop including the breech end of the rails as well as the armature. A switch means connected to the breech loop initiates the injection of the current and a shorted low ohmic resistance current conducting loop is disposed proximate the breech loop in substantial flux linking relationship therewith and in one embodiment is positioned between the switch means and the armature.

DESCRIPTION OF THE PREFERRED EMBODIMENT

Figure 1:
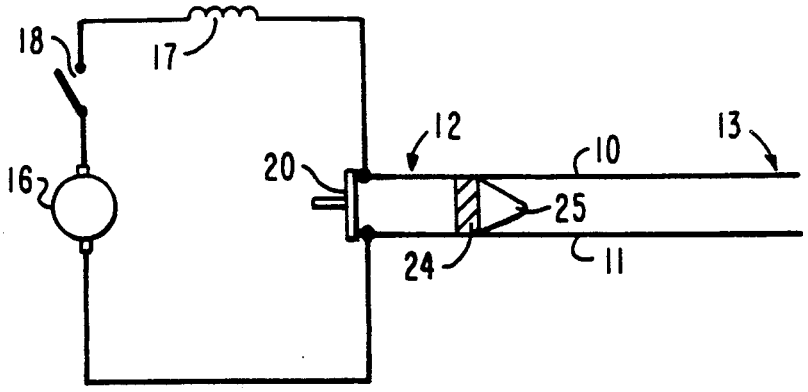
FIG. 1 PRIOR ART
FIG. 1 illustrates one type of typical electromagnetic projectile launcher.

A typical electromagnetic launcher, as depicted in FIG. 1, includes electrically conducting generally-parallel rail members 10 and 11 having a breech end 12 and a muzzle end 13. The breech end is connected to a high current source which includes a homopolar generator 16 connected in series with an inductive energy storage device in the form of inductor 17, the series connection being made upon closure of switch 18.

When the homopolar generator 16 (connected to a prime mover not illustrated) attains a predetermined rotational speed, all or a fraction of the kinetic energy thereof is transferred to inductor 17 when switch 18 is closed, and is then temporarily stored as electrical energy in inductor 17. During the inductor charging cycle, firing switch 20 connected to the breech end 12 of rails 10 and 11 remains in a closed condition. When the inductor current magnitude reaches an appropriate firing level, switch 20 is opened and current is commutated into rails 10 and 11 bridged by an electrically conducting armature 24 which may be of an electrically conducting solid material, or in some cases, a plasma or arc.

Upon the opening of firing switch 20, current flows down one rail, through the armature and back along the other rail such that the current flowing in the loop exerts a force on the armature 24 to accelerate a projectile 25. The accelerating force in essence is a function of the magnetic flux density and current density vectors, and since the current flowing in the rails is often measured in millions of amperes, projectile 25 exits the muzzle end 13 of the rail system at exceptionally high velocities measurable in many kilometers per second.

Figure 2:
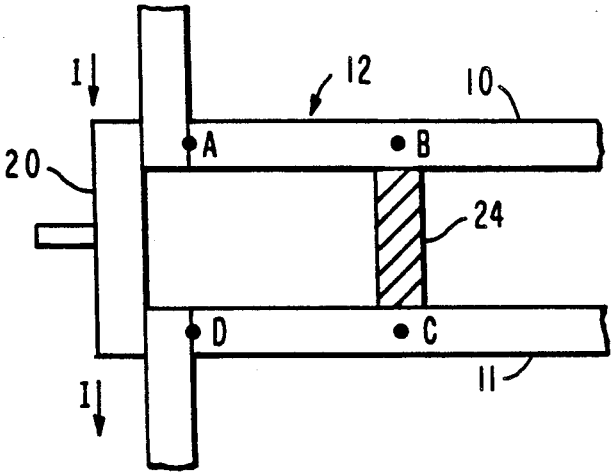
FIGS. 2 and 3 illustrate current flow through a portion of the apparatus of FIG. 1 under two different operating conditions.
Figure 3:
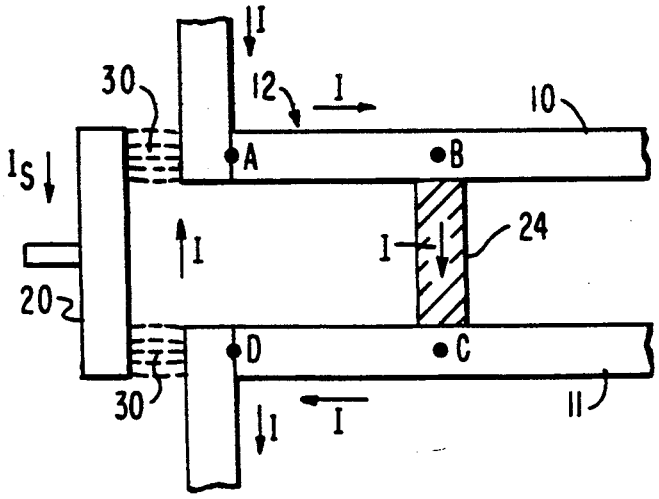

The commutation process is further illustrated in FIGS. 2 and 3 which illustrate, in simplified form, a portion of the breech end of the rails, as well as the firing switch 20. Just prior to commutation, and as illustrated in FIG. 2, inductor current I flows in the direction AD through firing switch 20. A breech loop is defined by ABCD with the path BC passing through armature 24. The current I, which is, to a good approximation, a constant current during the switching operation, is to be commutated into this breech loop.

In FIG. 3, firing switch 20 has commenced its separation. Of the total current I, the as-yet uncommutated current fraction $I_S$ still flows through switch 20 causing arcs 30 and generating a switch arc voltage $V_A$ which drives the current commutation.

If the inductance of the path AD through firing switch 20 is $L_S$ and the inductance of the breech path ABCD is $L_B$ then it may be shown that the commutation energy $E_C$ dissipated in the firing switch will be at least equal to:

$$E_C = \int I_S V_A dt = \tfrac{1}{2} I^2 (L_S + L_B) \quad (1)$$

From a mathematical computation model standpoint, commutation consists of establishing a closed loop current I flowing in the direction and loop ABCDA wherein that current which is caused to flow in path ABCD is the actual commutated current and the current flowing in the path and direction DA cancels, at the current zero, the original current which flowed through the switch, prior to commutation, in the opposite direction AD. The commutation duration dt can be estimated based upon the relationship:

$$\int V_A dt = \int (L_S + L_B) di \quad (2)$$

Although the commutation energy loss is completely acceptable from an overall energy efficiency viewpoint, it is noted that this energy loss is concentrated at the switch and is dissipated in arcing resulting in serious metal loss at the switch arc contact locations and in all likelihood will result in serious ablation of any switch insulating material. Such loss is totally unacceptable in apparatus which requires a firing switch to last for more than a few launches. With the present invention, arcing duration and arcing energy dissipation is significantly reduced resulting in an increase in the number of allowable switching operations before switch maintenance or replacement is required.

Figure 4:
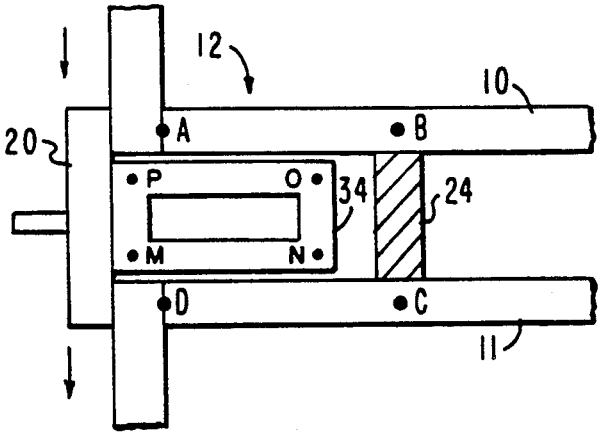
FIGS. 4 and 5 illustrate one embodiment of the invention under similar operating conditions as in FIGS. 2 and 3.

FIG. 4 is a view, as in FIG. 2, but further illustrating one embodiment of the present invention. The embodiment in FIG. 4 includes a single low ohmic impedance shorted loop 34 positioned in the breech loop ABCD in a manner to link substantially the total magnetic flux produced by current in loop ABCDA. The shorted loop is defined by points MNOP consituted by first and second parallel segments PO and MN as well as third and fourth parallel segments PM and ON.

Figure 5:
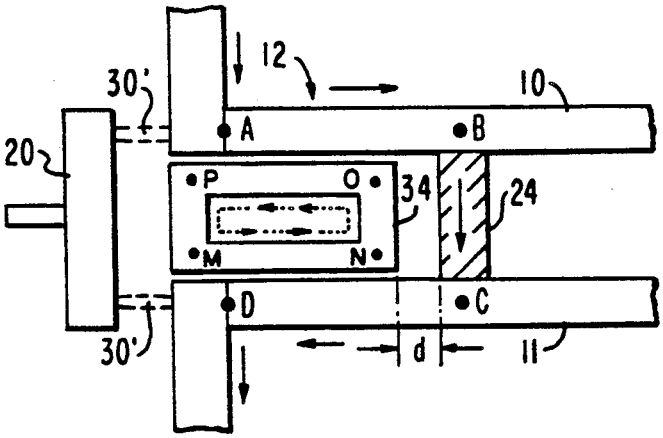

With the firing switch open, as in FIG. 5, current is commutated into the breech loop ABCD. The current flow creates a magnetic flux in the breech loop and due to the presence of shorted loop 34, there is generated therein a loop voltage in accordance with the well-known Lenz's law to generate a current to oppose the build-up of flux, this induced current being indicated by the dotted arrows and being of a magnitude slightly less than the breech loop current indicated by the solid arrows.

In accordance with basic magnetic circuit theory, a coupling coefficient $K_1$ may be defined as the fraction of the total flux produced by current in loop ABCDA which links the loop MNOPM. Similarly, a coupling coefficient $K_2$ is the total flux produced by current in loop MNOPM which links the breech loop ABCDA. It may be shown that the equivalent inductance $L_E$ during commutation is approximately equal to:

$$L_E = (L_S + L_B)(1 - K_1 K_2) \quad (3)$$

By proper design, the coupling coefficients may each have a value of 0.9 to thereby result in a breech loop equivalent inductance $L_E$ of less than 20% of the value than that obtained without the shorting loop 34. That is, in accordance with equation (3) with $K_1 = K_2 = 0.9$, $L_E = (L_S + L_B)(0.19)$. In accordance with equation (1), the commutation energy expenditure is proportional to the equivalent inductance into which current is commutated during the switching and since the equivalent inductance has been reduced to a fraction of its original value, there results a similar reduction in the switch commutation energy. In accordance with equation (2), a reduction of the inductive term results in a reduction of the duration of arcing, $\int dt$, with the commutation energy and duration of arcing being reduced by approximately a factor of 5, for the coupling coefficient values given. The net effect of the shorted loop addition in this example is a five-fold reduction of the arcing duration of arcs 30' at the switch contacts.

In FIG. 5, segment ON of loop 34 is spaced from armature 24 by a distance d. Were it not for this spatial separation, the initial acceleration force on armature 24 might be insufficient because of the relatively low magnetic flux density which would result behind the armature. The gap width d results in a high initial repulsion accelerating force due to the oppositely-directed currents through loop segment NO and armature path BC. Once the armature 24 has been accelerated through a predetermined distance from its starting location, normal rail-induced forces will predominate.

Figure 6:
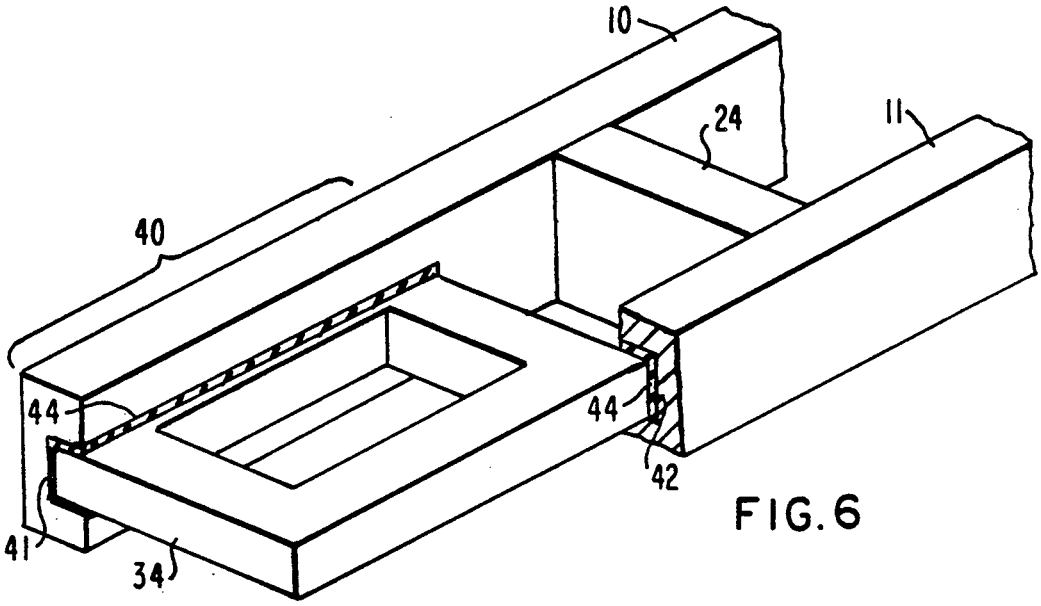
FIGS. 6, 7 and 8 illustrate various embodiments of the present invention.

In order to achieve the significant reduction in commutation energy, it is necessary that the flux linking relationship between the breech loop and the shorted loop be substantial so as to achieve coupling coefficients of, for example, 0.9 or even more. FIG. 6 schematically illustrates one arrangement for achieving high coupling coefficients utilizing a single shorted turn 34 that has previously been described. Portion 40 of rail 10 includes a groove 41 which accommodates one segment of shorted loop 34. In a similar fashion, rail 11 would include a facing groove 42 for accommodating another segment of shorted loop 34. The breech and shorted loops would be suitably insulated from one another such as by electrical insulation 44 and would link substantially all their flux because of the near coaxial nature of the two shorted loop legs of the rails. In this regard, although the rails 10 and 11 have been described as extending to and directly connected with the firing switch 20, it is to be understood that separate bus conductors could be utilized for the electrical connection, such bus conductors being in the breech loop.

Figure 7:
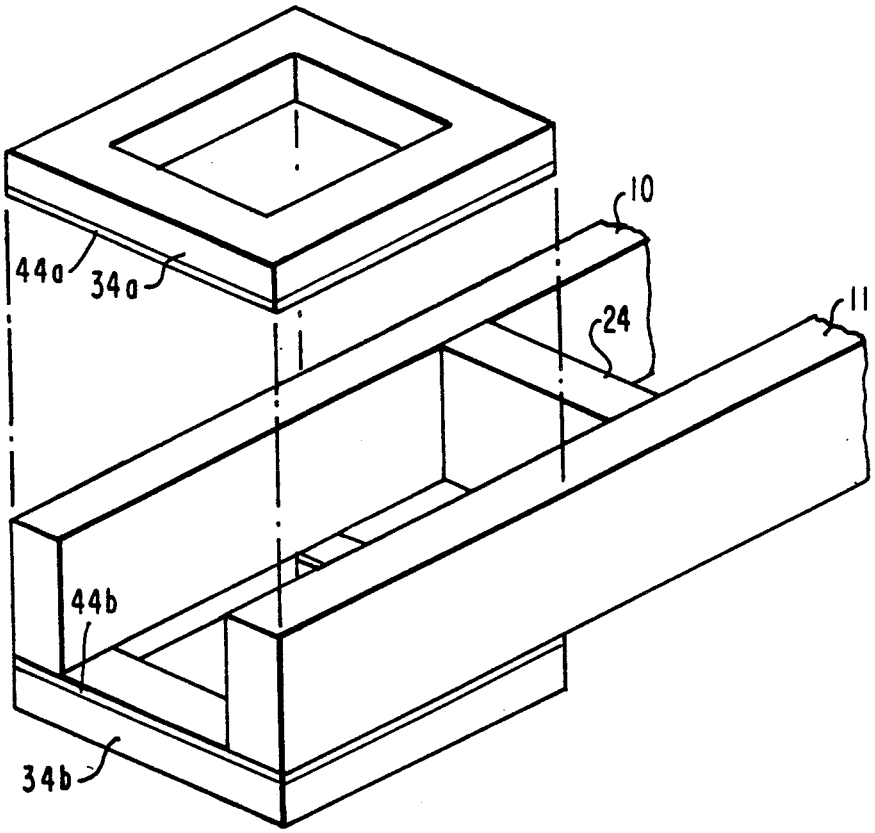

In the embodiment of FIG. 7, the flux linking relationship is accomplished with two shorted loops 34*a* and 34*b* disposed on opposite sides of the breech loop and preferable parallel to one another and electrically insulated from rails 10 and 11 by means of respective electrical insulation layers 44*a* and 44*b*. In such arrangement, the current induced, by Lenz's law, would be split between the two shorted loops.

Figure 8:
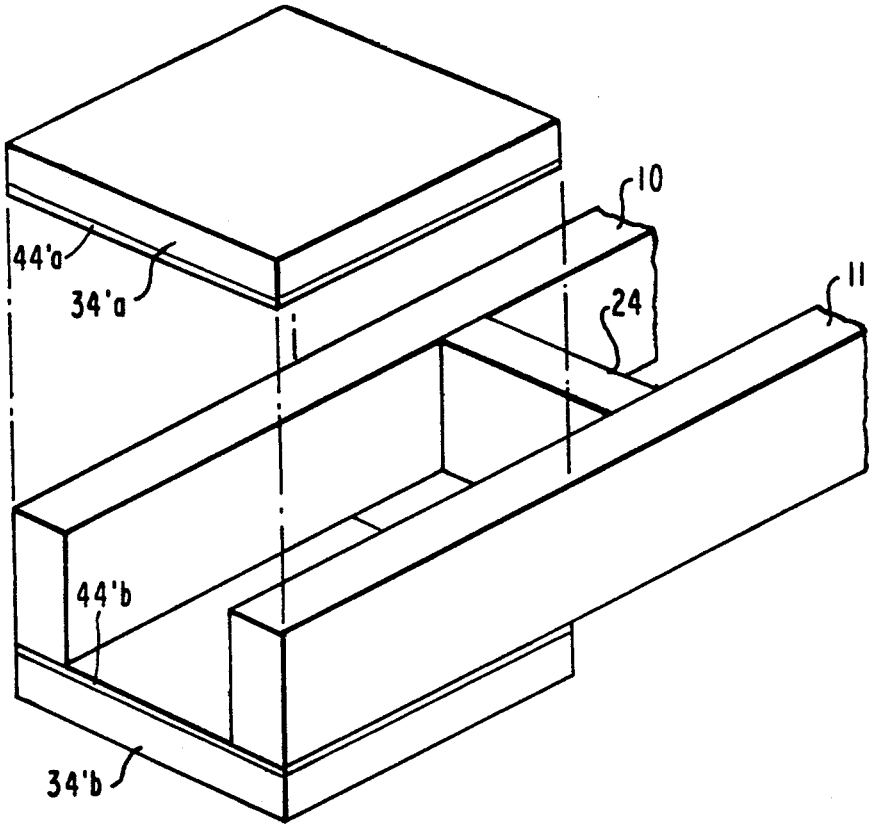

The shorted turns may be characterized as a low resistance path which lowers the equivalent inductance of the breech loop, and in which energy is dissipated by eddy currents as it would be in any conducting plate or loop subjected to a magnetic flux change. Accordingly, the shorted loop can take the form of a solid plate arrangement such as illustrated in FIG. 8 wherein electrically conducting plates 34'*a* and 34'*b* are disposed relative to the rails 10 and 11 in a manner similar to that illustrated by the shorted loops in FIG. 7 and electrically insulated from rails 10 and 11 by means of respective electrical insulation layers 44'a and 44'b. Similarly, although not illustrated, a single plate could be utilized in the grooved arrangement of FIG. 6.

It should be understood that in FIGS. 1 to 5, the firing or commutating switch 20 has for simplicity been illustrated as a single bar which opens the metallic circuit and initiates arcing when that bar is moved out of metallic contact with the breech rail extensions or bussing connected across the breech. Although the invention has thus been illustrated involving a single simple switching configuration, it should be apparent that a number of such similar simple switching configurations may be connected in parallel across the breech to operate in unison, or one or more circuit breakers, and if more than one, in parallel or series array, may perform the firing and commutation function. With a multiplicity of switching devices connected together in an array to perform the switching function, each of the devices should be in a high flux linking relationship with a shorted loop so that the equivalent inductance of the series circuit involving the switch array and the breech loop is minimized.

We claim:

1. Electromagnetic projectile launcher apparatus, comprising:

(A) a pair of generally parallel conducting rails having a breech end and a muzzle end;

(B) a source of high current;

(C) an armature for conducting current between said rails and for propelling a projectile along said rails;

(D) a breech loop including said breech end of said rails and said armature, and into which current from said source is injected to commence projectile acceleration;

(E) switch means connected to said breech loop to initiate said injection of said current; and (F) a shorted stationary current conducting loop proximate said breech loop and being electrically insulated therefrom and in substantial flux linking relationship therewith.

2. Apparatus according to claim 1 wherein:

(A) said shorted current conducting loop includes first and second segments parallel to one another and third and fourth segments parallel to one another;

(B) said breech loop includes first and second current carrying sections parallel to one another and including respective first and second facing grooves;

(C) said first and second segments of said shorted current conducting loop being respectively positioned within said first and second grooves.

3. Apparatus according to claim 2 wherein:

(A) said first and second grooves are formed in respective ones of said parallel conducting rails.

4. Apparatus according to claim 1 wherein:

(A) said shorted current conducting loop includes first and second segments parallel to one another and third and fourth segments parallel to one another;

(B) said third segment of said shorted current conducting loop is located proximate said switch means; and (C) said fourth segment and said shorted current conducting loop is located a predetermined distance behind said armature.

5. Apparatus according to claim 1 which includes:

(A) at least two of said shorted current conducting loops each being in substantial flux linking relationship with said breech loop.

6. Apparatus according to claim 5 wherein:

(A) each of said two shorted current conducting loops bridges said parallel conducting rails on opposite sides of said rails.

7. Apparatus according to claim 6 wherein:

(A) said two shorted current conducting loops are parallel to one another.

8. Apparatus according to claim 1 wherein:

(A) said shorted current conducting loop is a solid plate.

9. Apparatus according to claim 5 wherein:

(A) at least one of said shorted current conducting loops is a solid plate.

10. The method of reducing commutation energy in the firing of an electromagnetic projectile launcher having a power supply and a firing switch connected in a breech loop to the breech end of parallel launcher rails, comprising the steps of:

(A) providing at least one shorted current conducting loop;

(B) placing said shorted current conducting loop proximate said breech loop so as to be in substantial flux linking relationship therewith; and (C) opening said firing switch to commutate current from said power supply into said launcher rails.

11. A method in accordance with claim 10 which includes the step of:

(A) providing at least two said shorted current conducting loops proximate said breech loop so as to be in substantial flux linking relationship therewith.

12. Apparatus for injecting current into a current conducting loop comprising:

(A) a source of high current;

(B) switch means connected to said source and to said loop for providing a bypass path for said current, when said switch means is closed; and (C) a shorted low ohmic resistance current conducting loop proximate said first named current conducting loop and being electrically insulated therefrom and in substantial flux linking relationship therewith.

13. The method of high current injection into a first current conducting loop of an initially given inductance utilizing a switch connected to said first loop and which switch is initially in a closed position to conduct said high current, comprising the steps of:

(A) providing at least one shorted current conducting loop;

(B) placing said shorted current conducting loop adjacent said first current conducting loop so as to be in substantial flux linking relationship therewith to substantially reduce the equivalent inductance thereof when said switch is opened; and (C) opening said switch to inject said high current into said first current conducting loop.

* * * * *